US005133157A

United States Patent [19]

Hulskotte

[11] Patent Number: 5,133,157

[45] Date of Patent: Jul. 28, 1992

[54] APPARATUS FOR SHARPENING CUTTING EDGES OF KNIFE BLADES

[76] Inventor: Jan H. Hulskotte, Churchillstraat 67, NL-7591 CW Denekamp, Netherlands

[21] Appl. No.: 651,576

[22] Filed: Feb. 6, 1991

[30] Foreign Application Priority Data

Feb. 12, 1990 [NL] Netherlands ..... 9000335

[51] Int. Cl.[5] ..... B24B 9/04

[52] U.S. Cl. ..... 51/165.75; 51/74 BS; 51/98 BS; 51/102; 51/168; 51/73 R

[58] Field of Search ..... 51/74 BS, 98 BS, 102, 51/266, 267, 268, 272, 274, 285, 165.74, 165.75, 165.93, 166 TS, 168, 173, 73 R, 219 R, 218 A

[56] References Cited

U.S. PATENT DOCUMENTS

| | | | |
|---|---|---|---|
| 3,140,526 | 7/1964 | Tlamicha | 51/103 R |
| 3,332,173 | 7/1967 | McMaster | 51/102 |
| 4,236,355 | 12/1980 | Hennenfent et al. | 51/168 |
| 4,640,059 | 2/1987 | Komossa et al. | 51/5 D |
| 4,716,689 | 1/1988 | Friel | 51/285 |
| 4,974,370 | 12/1990 | Gosis | 51/111 R |

*Primary Examiner*—Bruce M. Kisliuk
*Assistant Examiner*—Eileen P. Morgan
*Attorney, Agent, or Firm*—Peter K. Kontler

[57] ABSTRACT

Apparatus for separately sharpening the two sides of cutting edges of knife blades in slaughterhouses, butcher shops and similar establishments has a housing for a ring-shaped flexible sharpening tool and a drum-shaped carrier for the tool. The carrier is driven by a reversible electric motor. A detachable wall of the housing in front of the tool supports two discrete V-shaped blade positioning members so that the positioning members extend into the space around an annular internal sharpening surface of the tool. One side of the cutting edge of a blade is sharpened while the blade is received in one of the positioning members in such orientation that the internal surface removes material in a direction from the back toward the cutting edge. The other side of the blade is thereupon treated while extending into the other positioning member and while the direction of rotation of the tool is reversed by a knob which is accessible at the exterior of the housing and can change the position of a barrier which blocks introduction of a blade into one of the positioning members while the other positioning member receives a blade and vice versa. The lower portion of the housing can confine a body of water which gathers removed particles of metallic material.

14 Claims, 2 Drawing Sheets

APPARATUS FOR SHARPENING CUTTING EDGES OF KNIFE BLADES

BACKGROUND OF THE INVENTION

The invention relates to sharpening apparatus in general, and more particularly to improvements in apparatus for sharpening cutting edges of butchers' knives and similar implements.

A knife which is used in a butcher shop, in a slaughterhouse or in a similar establishment must be sharpened at frequent intervals. In many instances, such knives are sharpened by hand, i.e., the handle or haft is held by the operator while a sharpening tool removes material from the blade in the region of the cutting edge. Manual sharpening is not entirely satisfactory, especially if the knife is to be sharpened at frequent intervals, because the quality of the sharpened cutting edge is not uniform from end to end and, furthermore, manual sharpening is highly likely to result in removal of excessive quantities of material from the blade with attendant reduction of the useful life of the implement. Even if the sharpening of the cutting edge happens to be satisfactory, repeated manual sharpening invariably entails a deformation of the cutting edge which is likely to exhibit pronounced hills and valleys or other undesirable configurations departing from an optimum shape.

OBJECTS OF THE INVENTION

An object of the invention is to provide a novel and improved sharpening apparatus which ensures predictable sharpening of cutting edges of knife blades irrespective of the frequency at which the sharpening operation must be repeated.

Another object of the invention is to provide an apparatus which is constructed and assembled in such a way that its sharpening tool does not or cannot remove excessive quantities of material in the course of a sharpening operation.

A further object of the invention is to provide an apparatus which is designed to prevent escape of removed material into the surrounding atmosphere.

An additional object of the invention is to provide an apparatus which can sharpen both sides of the cutting edge of a knife blade with the same degree of efficiency and to the same finish.

Still another object of the invention is to provide the apparatus with a novel and improved sharpening tool.

A further object of the invention is to provide the apparatus with novel and improved means for driving the sharpening tool.

Another object of the invention is to provide an apparatus which is adjustable to ensure proper positioning of different types and sizes of knives in the course of a sharpening operation.

An additional object of the invention is to provide an apparatus which is constructed and assembled in such a way that it can accept the blade of a knife or a like implement only when the blade is properly oriented relative to the sharpening tool.

A further object of the invention is to provide an apparatus which can be used with equal advantage and with equal economy in establishments of all sizes including large slaughterhouses as well as medium sized or small butcher shops, delicatessen, households and many others.

Another object of the invention is to provide a novel and improved housing and novel and improved controls for use in the above outlined apparatus.

SUMMARY OF THE INVENTION

The invention resides in the provision of an apparatus for sharpening cutting edges of knife blades. The improved apparatus comprises a rotary annular grinding tool having a sharpening surface, means for rotating the tool about its axis (preferably about a substantially horizontal axis), and guide means including at least one blade-positioning member having means for maintaining a blade in such orientation that the surface of the tool is in whetting contact with the blade, i.e., the sharpening surface removes material in a direction from the back toward the cutting edge of the blade in the positioning member. It is presently preferred to employ guide means including two blade-positioning members each of which has means for maintaining a blade in such orientation that the sharpening surface of the tool is in whetting contact with the blade in the respective positioning member. The two positioning members can be mirror images of each other with reference to a plane which includes the axis of rotation of the tool and is disposed midway between the two positioning members.

In accordance with a feature of the invention, the tool is flexible, at least at the sharpening surface so that it can be deformed by the blade in the one or the other positioning member.

The rotating means preferably comprises a reversible electric or other suitable motor which can rotate the tool clockwise and counterclockwise, means for reversing the direction of rotation of the motor, and a rotary drum-shaped carrier which transmits torque from the output element of the motor to the tool. The carrier can have a single opening adjacent the positioning members, and the tool is preferably removably or interchangeably installed in the single opening of the carrier.

The apparatus can further comprise means for adjusting at least one positioning member relative to the tool. The sharpening surface is preferably an annular internal surface of the tool, and the positioning members are inwardly adjacent such internal surface. The width of the internal surface (as measured in the axial direction of the tool) is preferably less than the length of at least one of the positioning members.

The reversing means can comprise a switch having an actuating element (e.g., a knob) which is located outside of a housing for the tool, for the tool carrier and for the positioning members. The knob of the reversing means is movable (e.g., turnable) between a first position in which the motor is set to rotate the tool in a clockwise direction and a second position in which the motor is set to rotate the tool in a counterclockwise direction. The apparatus can further comprise a barrier or gate which is operatively connected with (e.g., fixedly secured to) the knob of the reversing means to block introduction of a blade into one of the positioning members in the first position and to block introduction of a blade into the other positioning member in the other position of the knob. The arrangement may be such that the knob is further movable to a neutral position in which the motor is off and the barrier prevents introduction of a blade into either of the two positioning members.

The maintaining means of at least one of the positioning members is or can be substantially V-shaped.

The housing can include a main section which confines the tool and its carrier, and a wall which is separably secured to the main section in front of the tool and supports the positioning member or members. It is preferred to provide a suitable seal (e.g., a deformable ring) between the main section and the detachable wall of the housing in order to ensure that at least the lower portion of the housing (at a level below the positioning member or members) can confine a supply of liquid (e.g., water) without any or without excessive leakage of liquid. The housing is preferably provided with a liquid-admitting inlet (e.g., in its top wall) and with one or more liquid level indicators. The liquid collects particles which are removed from the blade in one of the positioning members or in the single positioning member to prevent contamination of the surrounding atmosphere.

The novel features which are considered as characteristic of the invention are set forth in particular in the appended claims. The improved sharpening apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
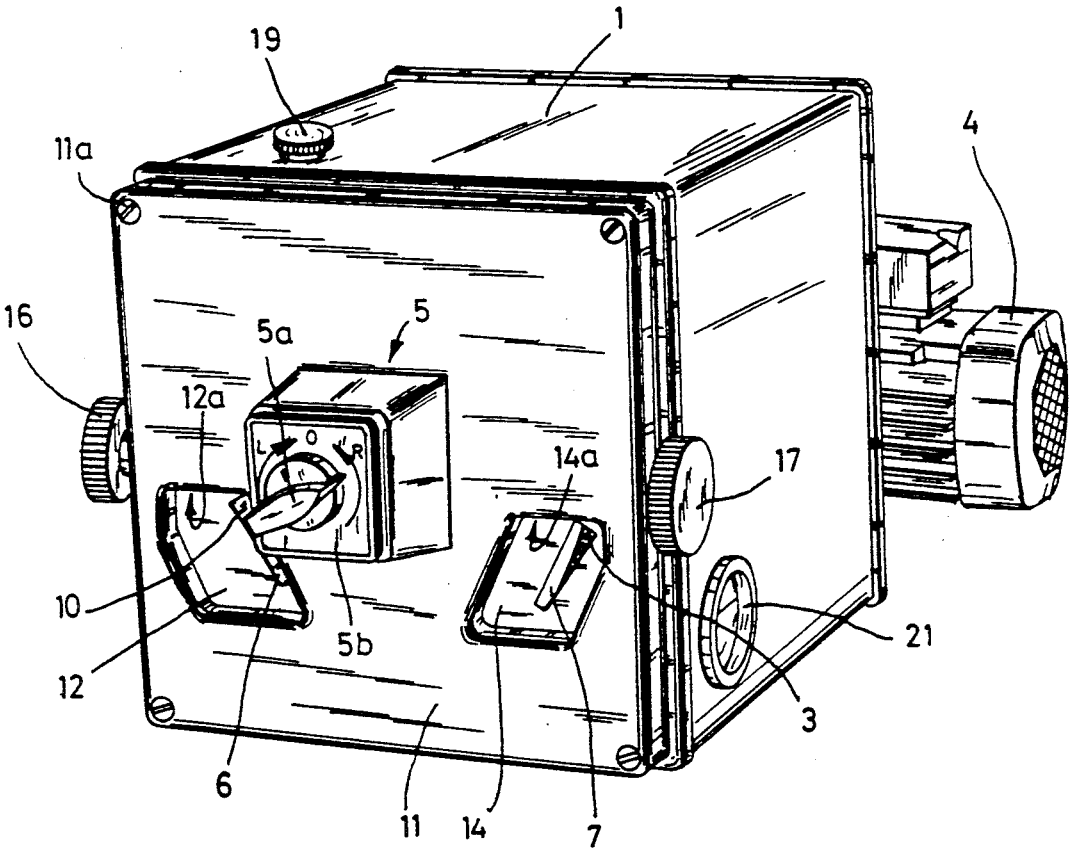
FIG. 1 is a perspective view of a sharpening apparatus which embodies one form of the invention and is provided with two mirror symmetrical blade positioning members which are mounted at the inner side of a detachable front wall of the housing for the rotary sharpening tool.
Figure 2:
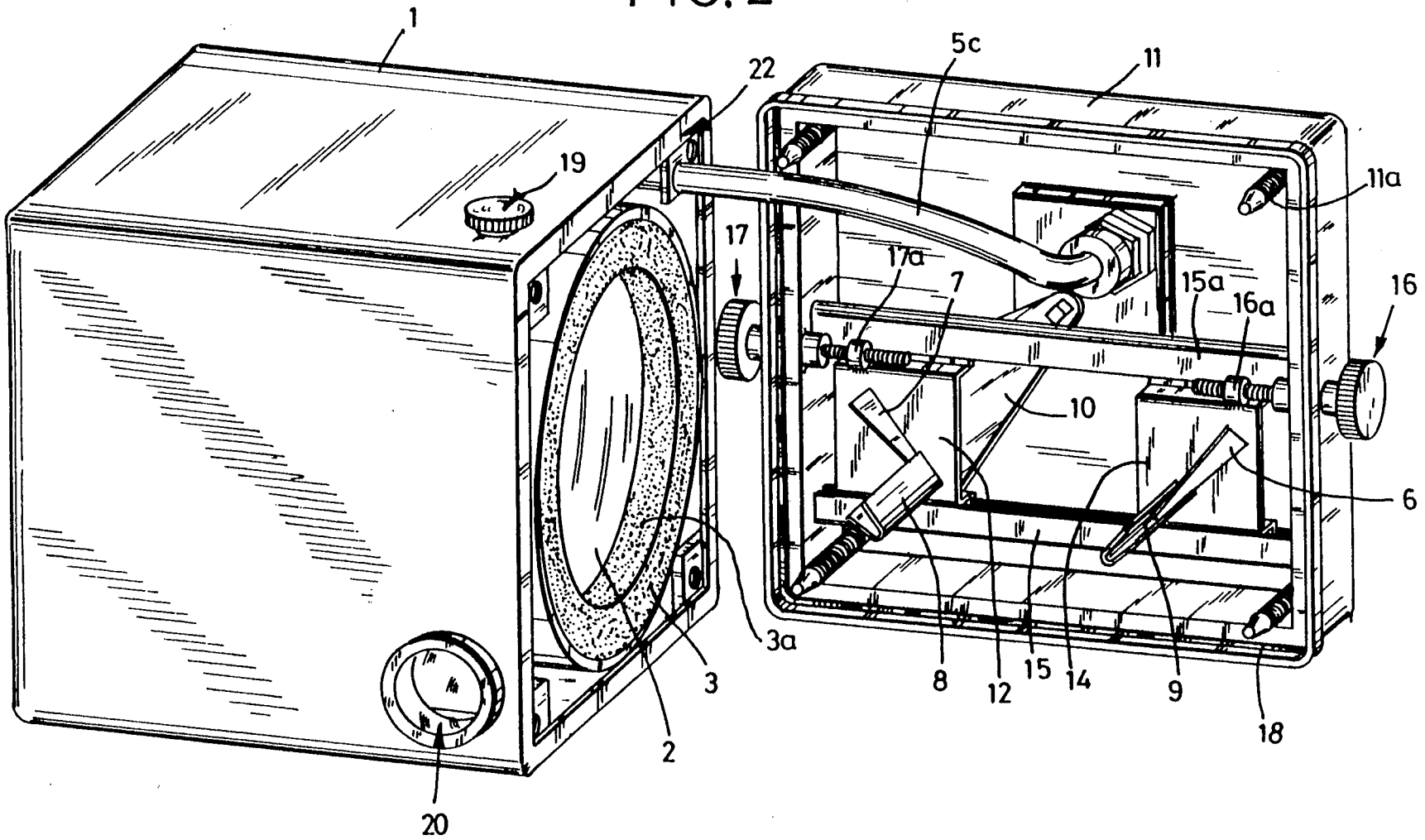
FIG. 2 is another perspective view of the sharpening apparatus of FIG. 1 but with the front wall detached from the main section of the housing to afford access to the tool and its carrier as well as to the blade positioning members and to a barrier which can prevent introduction of a knife blade into the one and/or the other positioning member.

The sharpening apparatus which is shown in FIGS. 1 and 2 comprises a box-shaped housing including a hollow main section 1 having a bottom wall, a top wall, a rear wall and two sidewalls, and a detachable front wall 11 which is separably secured to the main section by bolts, screws or other suitable fasteners 11*a*. The main section 1 confines a rotary drum-shaped carrier 2 which serves as a means for transmitting torque between a reversible electric motor 4 and a flexible (deformable) annular sharpening tool 3. The tool 3 is removably (i.e., interchangeably) installed in a single opening of the carrier 2, namely in an opening which is located behind the detachable front wall 11 when the latter is properly secured to the main section 1 of the housing. The tool 3 can be bonded, clamped or otherwise coupled to the carrier 2 so that it can be detached from the carrier subsequent to separation of the front wall 11 from the main section 1 of the housing. The apparatus can be furnished with one or more spare sharpening tools 3.

The annular internal surface 3*a* of the tool 3 is the sharpening surface, i.e., the surface comes in contact with the blade of a knife (not shown) when such blade is introduced into the housing by way of an inclined slot 6 or 7 which is provided in the front wall 11. More particularly, the slot 6 is provided in a horizontally reciprocable plate 14 which is movable along the inner side of the wall 11 behind a window 14*a*, and the slot 7 is provided in a second horizontally reciprocable plate 12 which is located at the inner side of the wall 11 behind a window 12*a*. The means for adjusting the plates 12, 14 relative to the windows 12*a*, 14*a* and relative to the tool 3 in the drum-shaped carrier 2 comprises two screws 17, 16 having heads which are accessible at the exterior of the housing including the main section 1 and the wall 11, and nuts 16*a*, 17*a* which are respectively provided on the plates 14, 12 and mate with the externally threaded shanks of the screws 16, 17, respectively. The plates 12, 14 are reciprocable along two horizontal tracks 15 and 15*a* which are affixed to the inner side of the wall 11.

Those sides of the plates 12, 14 which face the interior of the main section 1 of the housing respectively support discrete blade positioning members 8 and 9 each of which includes or is constituted by a substantially V-shaped or trough-shaped portion which maintains an inserted knife blade (not shown) in a predetermined orientation relative to the tool 3. The bottoms of the V-shaped or trough-shaped portions 8 and 9 receive the backs of inserted blades, and a blade which has been inserted into the positioning member 8 or 9 has certain freedom of angular movement, depending on the dimensions of the respective slot 7 (in the plate 12) or 6 (in the plate 14). This enables an operator to tilt an inserted blade along its back in order to move the respective side of the blade and the cutting edge against the internal surface 3*a* of the tool 3.

The means for reversing the direction of rotation of the motor 4 (and hence of the carrier 2 and tool 3) comprises an electric switch 5 which is mounted at the outer side of the wall 11 and is connected to the motor 4 by a cable 5*c* extending in part through the main section 1 of the housing. The motor 4 is outwardly adjacent the rear wall of the main section 1. The electrical connection between the switch 5 and the motor 4 is such that, when a rotary knob 5*a* of the switch is moved to a first position ("L" on the scale 5*b* at the front the wall 11), the tool 3 is rotated in a clockwise direction, and the tool 3 is rotated in a counterclockwise direction when the knob 5*a* is turned to the position "R". An additional indicium on the scale 5*b*, namely the symbol "O", is in register with the pointer of the knob 5*a* when the motor 4 is arrested.

The knob 5*a* is operatively connected to (e.g., rigid with) a plate-like barrier 10 which is located at the rear side of the wall 11 and is movable between a first position in which the barrier overlies the slot 6 to prevent introduction of a blade into the positioning member 9 when the tool 3 is driven to rotate in a counterclockwise direction, and a second position in which the barrier overlies the slot 7 and prevents introduction of a blade into the positioning member 8 when the tool 3 is rotated in a counterclockwise direction. The barrier 10 can simultaneously seal or overlap the slots 6 and 7 when the knob 5*a* is maintained in the third or neutral position in which its pointer registers with the symbol "O" on the scale 5*b*.

FIG. 1 shows that the barrier 10 overlies 5 the slot 6 but not the slot 7 because the motor 4 is set to rotate the tool 3 in a counterclockwise direction, i.e., the cutting edge of a blade which has been inserted into the positioning member 8 can be sharpened by the internal surface 3*a* of the tool 3 which carries out a whetting or honing action. Thus, the surface 3*a* removes material in a direction from the back toward the cutting edge of the inserted blade. The latter is moved back and forth (i.e., deeper into and outwardly from the main section 1 of the housing) in the course of a sharpening operation.

The length of the positioning members 8 and 9 (as seen in the axial direction of the tool 3) exceeds the width of the internal surface 3*a*.

The screw 16 or 17 will be manipulated to move the plate 14 or 12 (and hence the slot 6 or 7) relative to the internal surface 3*a* of the tool 3 in order to select an optimum position for a blade which has been introduced into the positioning member 9 or 8, depending upon which side of the inserted blade is to be acted upon by the internal surface 3*a*.

The marginal portion of the rear side of the wall 11 carries a deformable seal 18 which engages the front end face 22 of the main section 1 when the housing of the improved apparatus is fully assembled. This ensures that at least the lower portion of the housing (below the slots 6 and 7) can confine a supply of liquid (e.g., water) which is admitted by way of a sealable inlet 19 in the top wall of the main section 1. The bottom wall of the main section 1 is provided with an outlet (not shown) which serves to permit evacuation of spent liquid (i.e., a liquid which carries minute particles of material of the blades) from the housing. The liquid level in the lower portion of the housing can be observed by looking through one of two liquid level indicators 20, 21 provided in the sidewalls of the main section 1.

The mode of operation of the improved sharpening apparatus is as follows:

When the barrier 10 overlies the slot 6 but not the slot 7 (i.e., when the knob 5 assumes a position in which the motor 4 is set to rotate the tool 3 and the surface 3*a* in a counterclockwise direction (as viewed in FIG. 1)), an operator is free to introduce the blade of a knife through the slot 7 and into the corresponding positioning member 8 so that the back of the blade is located at the bottom of the V-shaped blade orienting portion of the member 8. The operator holds the handle of the knife and tilts the inserted blade along the back of the blade so that the cutting edge and the respective side of the blade are engaged by the internal surface 3*a* which performs a whetting or honing action by removing minute particles of material in a counterclockwise direction, i.e., upwardly toward and beyond the cutting edge at the top of the inserted blade.

The tool 3 is flexible so that it can be at least slightly deformed in response to application of pressure by the adjacent side of the properly inserted blade. The drum-shaped carrier 2 can also consist of an elastically deformable material, e.g., a synthetic plastic substance. The engaged portion of the internal surface 3*a* conforms to the shape of the adjacent portion of the respective side of the blade while the motor 4 is on to drive the tool 3 in a counterclockwise direction. The operator moves the blade longitudinally in directions deeper into and out of the drum-shaped carrier 2, while the motor 4 drives the tool 3, until the sharpening of one side of the cutting edge is completed. By selecting the size of abrasive material which coats the internal surface 3*a*, as well as by properly selecting the material of the particles, one can ensure that the respective side of the blade is treated to a high degree of finish as well as that the cutting edge is properly sharpened. In fact, the abrasive material at the surface 3*a* can treat the respective side of a blade to a finish which matches that of a lapping machine.

The blade is then extracted from the housing by way of the slot 7 and the angular position of the knob 5*a* is changed so that the barrier 10 overlies the slot 7 but exposes the slot 6. The motor 4 is then set to rotate the tool 3 in a clockwise direction to ensure that the surface 3*a* removes material from the other side of the blade (which has been inserted into the positioning member 9 by way of the slot 6) in a manner analogous to that described above. Thus, the blade can be tilted in the slot 6 along its back and its theretofore untreated side is caused to bear against the internal surface 3*a* so that the abrasive material at the surface 3*a* removes metallic material of the blade in a direction upwardly toward and beyond the cutting edge. The blade is also moved longitudinally to ensure full treatment of the entire side, i.e., along the entire cutting edge.

The barrier 10 constitutes an optional but highly desirable safety feature. Thus, an inexperienced operator cannot insert a blade into the positioning member 8 or 9 until and unless the motor 4 is already set to rotate the tool 3 in the proper direction. As mentioned above, the barrier 10 can simultaneously seal the slots 6 and 7 when the motor 4 is off, i.e., when the pointer of the knob 5*a* of the reversing switch 5 registers with the symbol "O" on the scale 5*b*.

The knife is grasped by its handle during insertion of the blade into a selected positioning member, during sharpening of the cutting edge, and during extraction of the blade from the selected positioning member. The body of liquid can fill the lower portion of the drum-shaped carrier 2 to ensure that the removed particles of metallic material of the blade can descend into the liquid and cannot escape from the housing, even when the blade is extracted from the positioning member 8 or 9. The carrier 2 further reduces the likelihood of escape of unmoistened particles of removed metallic material from the housing. The liquid wets the internal surface 3*a* of the tool 3 in the course of the sharpening operation. It has been found that the improved apparatus prevents contamination of the surrounding atmosphere by particles of abrasive material and/or by removed metallic particles.

The improved apparatus is susceptible of numerous modifications without departing from the spirit of the invention. For example, the adjusting mechanism including the screws 16, 17 and nuts 16*a*, 17*a* can be replaced by rack and pinion drives, by Bowden wires or by any other suitable adjusting means. Furthermore, the shape of the housing can depart from the illustrated configuration. The sharpening apparatus can have a single slot (6 or 7) and a motor which drives the tool in a single direction. It is then necessary to use two apparatus, one for the treatment of one side and the other for the treatment of the other side of a blade.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for sharpening cutting edges of knife blades, comprising a rotary annular grinding tool having a sharpening surface; means for rotating said tool including a reversible motor, means for transmitting torque from said motor to said tool, and means for reversing the direction of rotation of said motor, said reversing means being movable between a first position in which said motor is set to rotate said tool in a clockwise direction and a second position in which said motor is set to rotate said tool in a counterclockwise direction; guide means including two blade-positioning members each having means for maintaining a blade in such orientation that the tool is in whetting contact with the blade in the respective member; and a barrier operatively connected with said reversing means to block introduction of a blade into one of said members in the first position and to block introduction of a blade into the other of said members in the second position of said reversing means.

2. The apparatus of claim 1, wherein said tool is flexible, at least at said sharpening surface thereof.

3. The apparatus of claim 1, wherein said rotating means further comprises a rotary drum-shaped carrier detachably supporting said tool.

4. The apparatus of claim 1, further comprising means for adjusting at least one of said members with reference to said tool.

5. The apparatus of claim 1, wherein said sharpening surface is an annular internal surface of said tool and said members are inwardly adjacent said internal surface.

6. The apparatus of claim 1, further comprising a housing for said tool and for said members, said reversing means being located outside of said housing.

7. The apparatus of claim 1, wherein the maintaining means of at least one of said members is substantially V-shaped.

8. The apparatus of claim 1, wherein said rotating means further includes a rotary drum-shaped carrier having a single opening, said tool being installed in said opening.

9. The apparatus of claim 1, wherein said sharpening surface is an annular surface having a predetermined width in the axial direction of said tool, at least one of said members having a length greater than said predetermined width.

10. The apparatus of claim 1, wherein said rotating means further including a rotary drum-shaped carrier for said tool and further comprising a housing for said carrier and said tool, said housing including a main section and a wall separably secured to said main section in front of said tool.

11. The apparatus of claim 10, further comprising a seal between said main section and said wall.

12. The apparatus of claim 10, wherein said members are mounted on said wall.

13. The apparatus of claim 1, further comprising a housing for said tool and said members, said housing having a liquid-admitting inlet.

14. The apparatus of claim 13, wherein said housing comprises at least one liquid level indicator.

* * * * *